US007052340B1

(12) United States Patent
Broussard

(10) Patent No.: US 7,052,340 B1
(45) Date of Patent: May 30, 2006

(54) METHOD AND APPARATUS FOR AIR COOLED OUTBOAD MOTOR FOR SMALL MARINE CRAFT

(76) Inventor: Kyle Broussard, P.O. Box 401, Loreauville, LA (US) 70552

( * ) Notice: Subject to any disclaimer, the term of this patent is extended or adjusted under 35 U.S.C. 154(b) by 0 days.

(21) Appl. No.: 10/662,487

(22) Filed: Sep. 15, 2003

Related U.S. Application Data

(60) Provisional application No. 60/411,701, filed on Sep. 17, 2002.

(51) Int. Cl.
*B63H 20/14* (2006.01)

(52) U.S. Cl. ..... 440/75

(58) Field of Classification Search ..... 440/75, 440/900, 49, 76
See application file for complete search history.

(56) References Cited

U.S. PATENT DOCUMENTS

| | | | | |
|---|---|---|---|---|
| 941,827 | A | 11/1909 | Trouche | |
| 1,953,599 | A | 4/1934 | Grimes | |
| 2,722,193 | A * | 11/1955 | Brindley | 440/49 |
| 3,752,111 | A | 8/1973 | Meynier, Jr. | |
| D259,488 | S | 6/1981 | Carter et al. | |
| 4,726,796 | A | 2/1988 | Rivette et al. | |
| 4,869,692 | A * | 9/1989 | Newman | 440/75 |
| 4,992,066 | A * | 2/1991 | Watson | 440/75 |
| 5,178,566 | A * | 1/1993 | Stojkov et al. | 440/75 |
| 5,336,119 | A | 8/1994 | Lais et al. | |
| 5,415,576 | A * | 5/1995 | Meisenburg et al. | 440/80 |
| 5,435,763 | A | 7/1995 | Pignata | |
| 5,722,866 | A * | 3/1998 | Brandt | 440/67 |
| 6,302,750 | B1 | 10/2001 | Foreman | |
| 6,468,120 | B1 * | 10/2002 | Hasl et al. | 440/61 R |

* cited by examiner

*Primary Examiner*—Lars A. Olson
(74) *Attorney, Agent, or Firm*—Robert N. Montgomery

(57) ABSTRACT

An air cooled, belt drive and engine assembly mountable to the transom of small flat bottom boats in much the same manner as water cooled outboard engines with a lower foot that does not extend below the bottom of the boat but extends a sufficient distance behind the boat to insure the proper angle of attack when the propeller is in contact with mud and vegetation. The engine mount includes tilt-up capability and pivotal horizontal steering. The propeller is capable of cutting through vegetation, provides propulsive thrust in mud and provides relatively fast boat speed in deep water.

14 Claims, 4 Drawing Sheets

METHOD AND APPARATUS FOR AIR COOLED OUTBOAD MOTOR FOR SMALL MARINE CRAFT

FIELD OF THE INVENTION

This application claims priority to applicant's provisional application No. 60/411,701 filed Sep. 17, 2002.

This invention relates generally to transom-mounted outboard motors for small marine watercraft and more particularly to air-cooled engines belt driven propeller shafts for shallow draft watercraft.

GENERAL BACKGROUND

Small marine craft operating primarily in shallow water are often referred to as mud boats. Such boats are usually shallow draft flat bottom boats powered by in-board air cooled engines with outboard drives adapted to pass through the hull or transom for coupling to the engine, as disclosed by U.S. Pat. Nos. 941,827, 3,752,111 and 4,726,796.

In some cases small air cooled engines have been adapted for fixed attachment to a boat's transom for pivotal steering in the horizontal plane, with an extended drive shaft extending rearwardly to just below the water line at an angle of approximately 30 degrees as illustrated by Foreman in U.S. Pat. No. 6,302,750.

Other patents, such as Cater et al. in U.S. Des. 259,488 illustrate the use of an air cooled engine pivotally mountable to the boat's transom with the same elongated drive shaft extending to just below the waterline perhaps at a somewhat greater angle, depending on the height of the transom. In most cases the drives are designed not to extend below the bottom of the hull.

Lais et al. have also used electric motors in combination with a belt drive to maneuver small craft such as that disclosed in U.S. Pat. Nos. 5,336,119 and 1,953,599. However, obviously such drives are not intended for high speed or for extended powering through vegetation in shallow water.

The use of belt drive engines are well known within the art as being a most efficient means for driving a propeller shaft thereby reducing friction and improving mechanical advantage over right angle gear drives. Therefore, the use of a belt drive in combination with an air cooled engines as disclosed by Pignata in U.S. Pat. No. 5,435763 seems to be an obvious choice. However, Pignata utilizes a unique internal propeller arrangement and with a through the transom coupling for an inboard air-cooled engine with pivotal kick-up capability or over the top of the transom arrangement. However, Pignata fails to fully disclose how either such arrangement may be steered effectively. While the Pignata apparatus may be useful in open water it is far from obvious that it could be adapted for use in shallow water marsh with heavy mud and vegetation. The internal propeller housing must be located below the boat hull for water to be drawn effectively through the internal propeller blades. Therefore, if the propeller housing is above the bottom of the boat's hull water flow would be blocked. Shallow draft boats are known to create a depression at speed for some distance directly behind the transom it is therefore essential that the propeller shaft extend below the boat hull or beyond the water depression to make sufficient contact with the water to provide thrust and prevent cavitations.

Mud boats rely a great deal on propeller contact with the mud and the propeller's ability to cut the vegetation to help drive the boat. Hence the concept of having an elongated drive shaft extending at a shallow angle from above a boat's transom to just below the water surface has long been the excepted practice for mud boats. However, the use of a fixed inboard engine with a through transom coupling limits the apparatus to a particular boat and therefore may not be removed and mounted on another boat without extensive modifications. The use of a removable over the transom mounted air-cooled engine with extended drive shaft is awkward and often limited to a relatively low horsepower engines. There is obviously a need to provide a relatively high horsepower air cooled, efficient belt drive engine that mounts to small, flat bottom boats in much the same manner as water cooled outboard engines with a foot that does not extend below the bottom of the boat but extends a sufficient distance behind the boat to insure the proper angle of attack when the propeller is in contact with mud and vegetation.

SUMMARY OF THE INVENTION

A relatively high horsepower air cooled, efficient belt drive engine that mounts to the transom of small flat bottom boats in much the same manner as water cooled outboard engines with a lower foot that does not extend below the bottom of the boat but extends a sufficient distance behind the boat to insure the proper angle of attack when the propeller is in contact with mud and vegetation. This arrangement allows for a shorter turning radius than can be achieved by the prior art transom mounted mud motors. The engine mount includes tilt-up capability and pivotal horizontal steering. The propeller is capable of cutting through vegetation, provides propulsive thrust in mud and provides relatively fast boat speed even in deep water.

BRIEF DESCRIPTION OF THE DRAWING

For a further understanding of the nature and objects of the present invention, reference should be made to the following detailed description taken in conjunction with the accompanying drawings, in which, like parts are given like reference numerals, and wherein.

DETAILED DESCRIPTION OF THE PREFERRED EMBODIMENT

Figure 1:
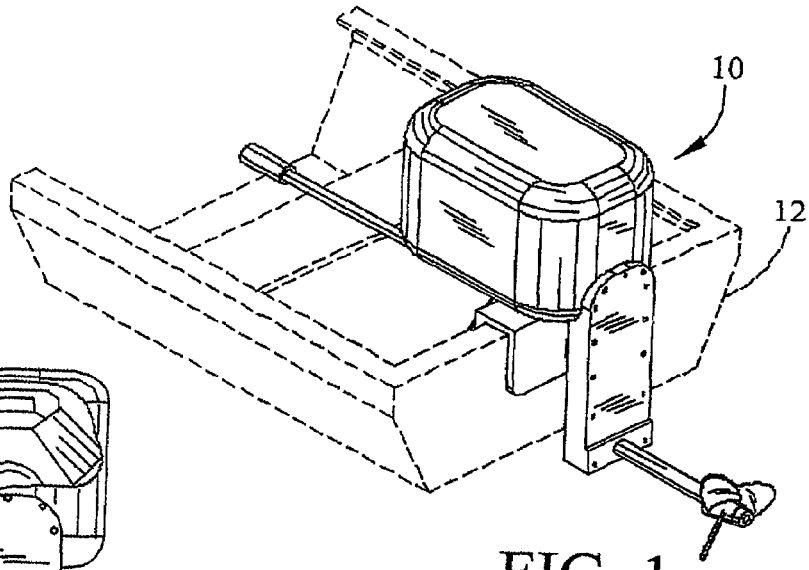
FIG. 1 is a rear isometric view of the preferred embodiment as attached to a small boat.
Figure 2:
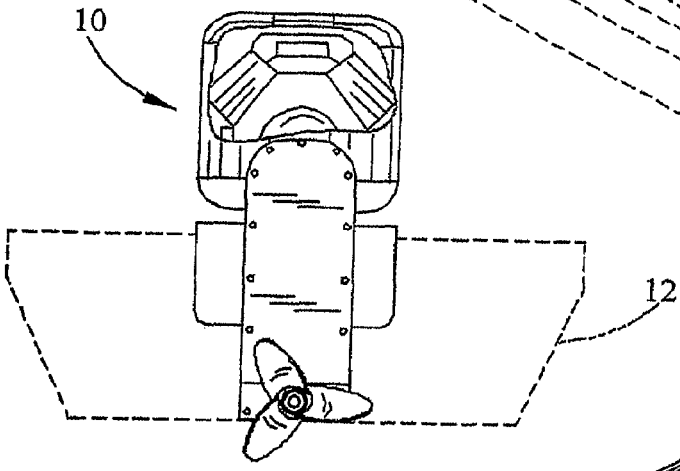
FIG. 2 is a rear view of the preferred embodiment.
Figure 3:
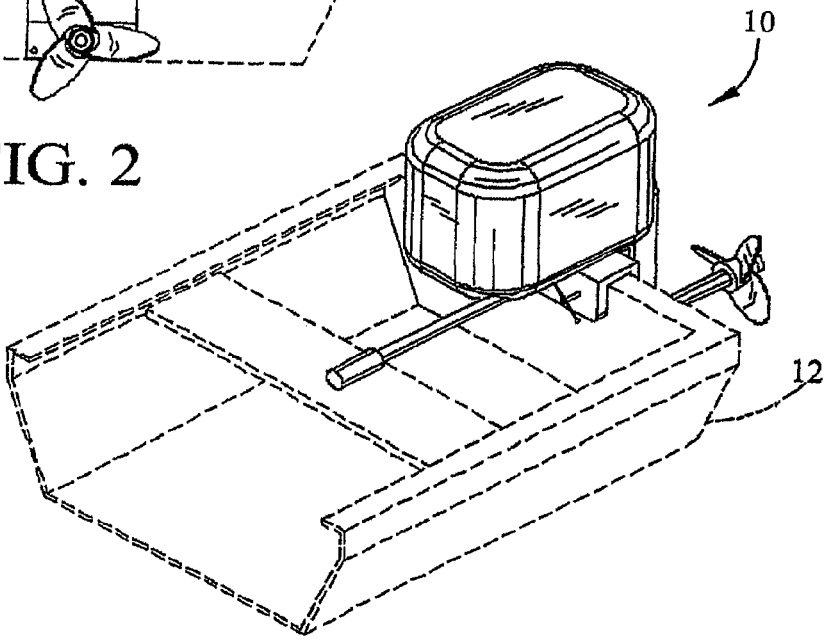
FIG. 3 is a forward isometric view of the preferred embodiment as attached to a small boat.
Figure 4:
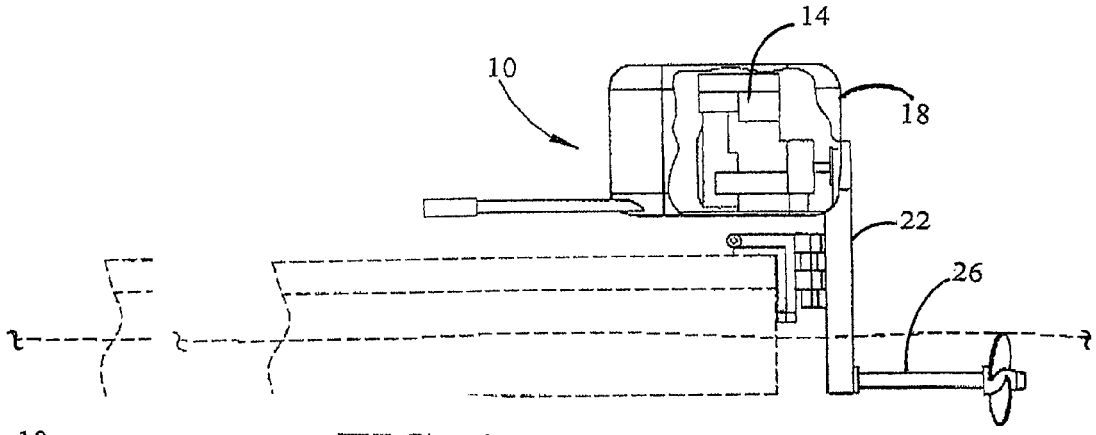
FIG. 4 is a side elevation view of the preferred embodiment with cowling cut-a-way showing engine.
Figure 5:
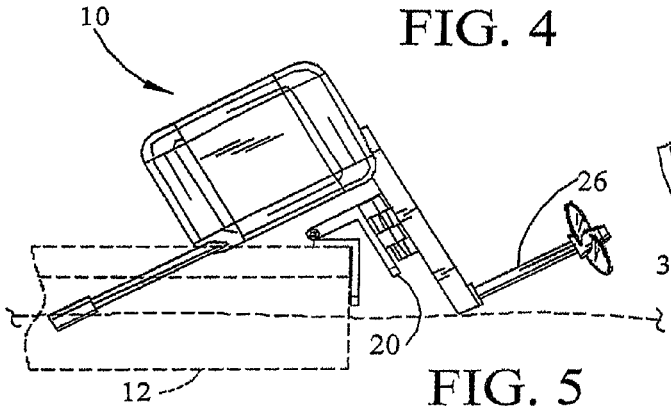
FIG. 5 is a side elevation view of the preferred embodiment in the tilted position.
Figure 6:
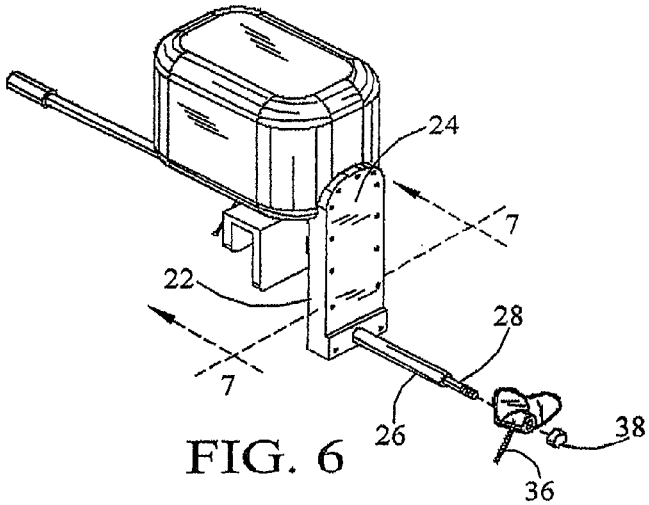
FIG. 6 is a rear isometric view of the preferred embodiment with propeller exploded view.
Figure 7:
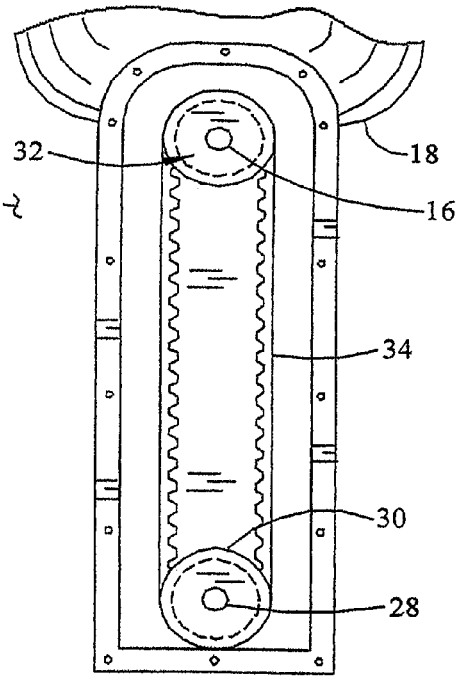
FIG. 7 is a cross section view taken along sight lines 7—7 seen in FIG. 6 with cover removed.
Figure 9:
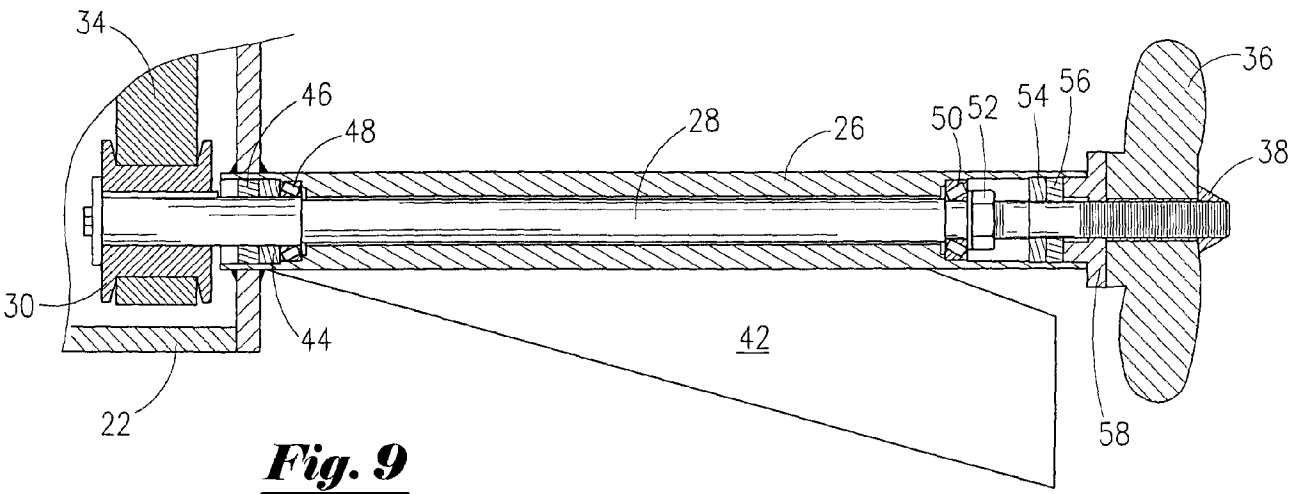
FIG. 9 is a cross section view of the propeller shaft housing.

As first seen in FIG. 1 the belt drive, air cooled outboard engine assembly 10 is mounted to a small flat bottom boat 12 in the conventional manner on the hull's center line as seen in FIG. 2. As may be seen in FIG. 3 the engine assembly 10 is steerable and throttle operated in much the same manner as a water-cooled outboard engine. The air-cooled engine 14 is vertically mounted with a horizontal shaft 16 seen in FIG. 7 and is structurally supported and enclosed in a cowling 18 having adequate ventilation louvers to allow for engine cooling as illustrated in FIG. 4. However, in some cases the cowling may be removed for greater cooling capability. The engine assembly 10 is pivotal in a kick-up position in the horizontal plane as well as the vertical plane in the typical outboard mounting arrangement as illustrated in FIG. 5. The engine belt drive assembly 10 to which the air-cooled utility engine is closely attached is enclosed in a water tight housing 22 seen in FIG. 6 and exposed in FIG. 7. The housing is fitted with a removable cover 24. The drive housing 22 is adjustable attached to the transom in a manner whereby the drive housing extends only to a point approximately flush with the keel or bottom of the boat as seen in FIG. 4. The drive housing 22 further houses the lower propeller shaft assembly 26, and includes the output propeller shaft 28, its timing belt type driven pulley 30 and shaft support bearings 48, shown in FIG. 9, a timing belt type drive pulley 32 and timing belt 34 as seen in FIG. 7. A propeller 36 seen in FIG. 6 designed generally used specifically for mud and marsh operation is fitted to the drive shaft 28 and secured thereto in the usual manner by key or pin, threaded nut 38 and retainers.

Figure 8:
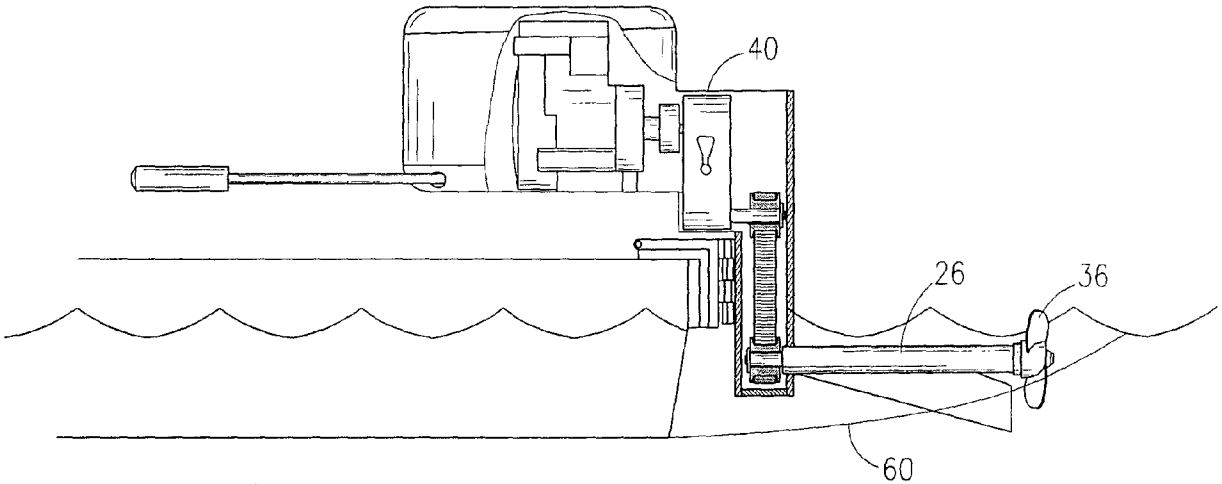
FIG. 8 is a partial cross section view of the boat drive system with reverse transfer case.

In some cases it may be advantageous to equip the drive with a transmission 40 having a reverse gear transfer component adaptively connected and coupled as shown in FIG. 8. Looking now at FIG. 9 we see that the shaft housing assembly further includes a kick up rudder fin 42, with inner and outer shaft seals 44, 46 located at the head end of the housing behind a tapered roller thrust bearing 48. A similar tapered roller thrust bearing 50 is located within the housing assembly 26 at the tail end of the shaft 28, secured by a shaft bearing retaining nut 52. The tail end of the shaft housing assembly 26 is also sealed with inner and outer seals 54, 56. In some cases a sub-housing 58 is threadably secured to the shaft 28 and protrudes within the housing 26 to prevent intrusion of mud and debris. The water trough 60 seen in FIG. 8 directly behind the transom of a speeding boat varies with its speed. Therefore, its is necessary to extend the length of the propeller shaft 28 and its housing assembly 26 a significant distance in excess of 18 inches from the belt drive housing 22 in accordance with the horsepower of the engine 14. In general the length of the shaft and housing can be kept relatively short with a medium horsepower rated engine.

Figure 10:
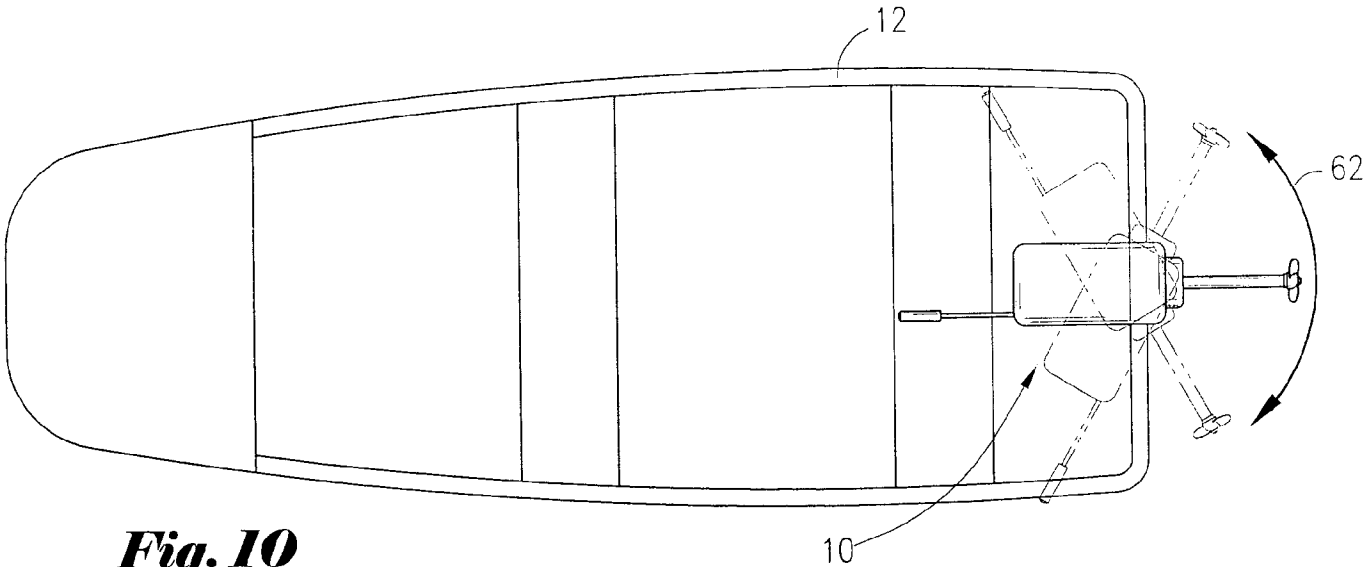
FIG. 10 is a top view of the boat drive system.
Figure 11:
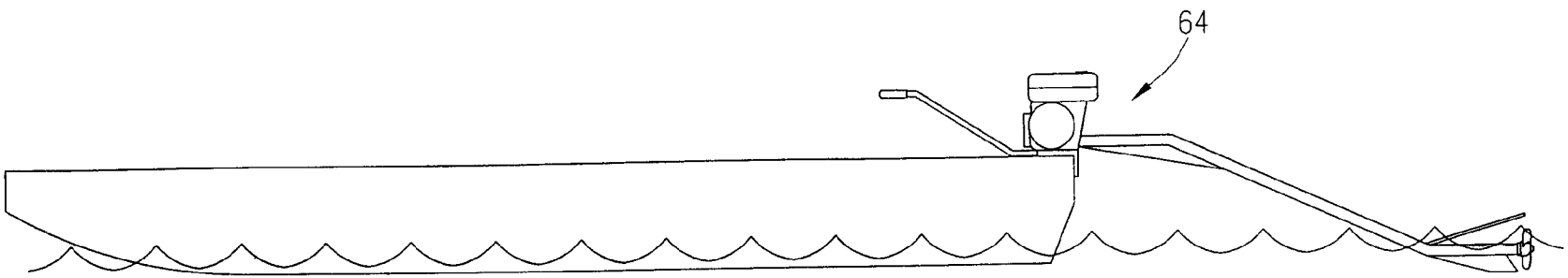
Fig. 11 PRIOR ART
FIG. 11 is side elevation of a prior art drive system.

Therefore, the hull's turning arc 62 is by contrast far shorter as shown in FIG. 10 than can be achieved by the prior art drive arrangement 64 shown in FIG. 11 for the same size hull and horsepower rated engine.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in any limiting sense.

What is claimed is:

1. A portable drive assembly having means for temporary attachment to the transom of a shallow draft watercraft said portable drive assembly comprising an elongated drive housing enclosing an upper drive assembly a lower driven assembly and a timing belt connecting said upper drive assembly to said lower driven assembly, an engine mounting plate attached externally to said drive housing located adjacent said upper drive assembly perpendicular to said drive housing said lower driven assembly further comprising a propeller shaft partially enclosed within a shaft housing attached to said drive housing adjacent said driven assembly extending at least 12 inches beyond said drive housing and a propeller attached to said propeller shaft.

2. The portable drive assembly according to claim 1 wherein said portable drive assembly further comprising a transmission mounted to said engine mounting plate coupled externally to said upper drive assembly for reversing drive rotation.

3. The portable drive assembly according to claim 1 wherein said drive system further comprises steering and throttle controls.

4. The portable drive assembly according to claim 1 wherein said propeller shaft assembly further comprises a shaft housing having a vertical triangular fin located below said shaft housing, a shaft supported adjacent each end by thrust bearings in a manner whereby said shaft extends beyond each of said thrust bearings and a plurality of internal seals located along said shaft outboard of said thrust bearings.

5. The portable drive assembly according to claim 1 wherein said upper drive assembly and said lower driven assembly further include timing pulleys compatible with said timing belt said belt being rotationally unobstructed or acted upon by other bodies.

6. The portable drive assembly according to claim 1 further comprising a self contained air cooled utility engine having a horizontal output shaft attached to said engine mounting plate said output shaft coupled to said upper drive assembly.

7. The portable drive assembly according to claim 6 wherein said drive housing is water sealed.

8. A portable outboard engine and drive assembly having means for temporary attachment to the transom of a shallow draft watercraft comprising:

a) a sealed housing containing a timing belt drive assembly comprising an upper drive pulley assembly and a lower driven pulley assembly;

b) an engine mounting plate attached externally to said sealed housing located adjacent said upper drive pulley assembly perpendicular to said sealed housing;

c) a propeller shaft partially enclosed within a shaft housing attached to said sealed housing extending from said driven pulley assembly at least 12 inches beyond said sealed housing;

d) a propeller attached to said propeller shaft;

e) a pivotal means for temporarily attaching said sealed drive housing to a boat transom; and f) an air cooled engine mounted to said engine-mounting plate and coupled externally to said upper drive pulley assembly.

9. The portable drive assembly according to claim 8 wherein said pivotal means comprises both horizontal and vertical pivoting means.

10. The portable drive assembly according to claim 8 wherein said portable drive assembly further comprises a transmission connected between said air-cooled engine and said upper drive pulley assembly.

11. The portable drive assembly according to claim 8 wherein said propeller shaft assembly further comprises a plurality of thrust bearings and seals at each end of said shaft housing.

12. The portable drive assembly according to claim 11 wherein said propeller shaft assembly further comprises a rudder fin extending below said shaft housing.

13. The portable drive assembly according to claim 8 wherein said propeller shaft assembly is in excess of 18 inches in length.

14. A method of driving a small watercraft in very shallow water comprising the steps of:

a) attaching a portable drive assembly having means for temporary attachment to the transom of a shallow draft watercraft said portable drive assembly comprising an elongated drive housing enclosing an upper drive assembly, a lower driven assembly and a timing belt connecting said upper drive assembly to said lower driven assembly, an engine mounting plate attached externally to said drive housing located adjacent said upper drive assembly perpendicular to said drive housing, said lower driven assembly further comprising a propeller shaft partially enclosed within a shaft housing attached to said drive housing adjacent said driven assembly extending at least 12 inches beyond said drive housing, and a propeller attached to said propeller shaft;

b) attaching an air cooled utility engine to said engine mounting plate and coupling said air cooled utility engine to said upper drive assembly; and c) adjusting said pivotal transom mounting bracket relative to said transom in a manner whereby said propeller shaft assembly does not extend below the bottom of said watercraft when driving said watercraft.

* * * * *

US007052340C1

(12) EX PARTE REEXAMINATION CERTIFICATE (8005th)

United States Patent

Broussard

(10) Number: US 7,052,340 C1

(45) Certificate Issued: Jan. 25, 2011

(54) METHOD AND APPARATUS FOR AIR COOLED OUTBOARD MOTOR FOR SMALL MARINE CRAFT

(75) Inventor: Kyle Broussard, Loreauville, LA (US)

(73) Assignee: Gator Tail, LLC, Loreauville, LA (US)

Reexamination Request:
No. 90/009,698, Apr. 8, 2010

Reexamination Certificate for:

| | |
|---|---|
| Patent No.: | **7,052,340** |
| Issued: | **May 30, 2006** |
| Appl. No.: | **10/662,487** |
| Filed: | **Sep. 15, 2003** |

Related U.S. Application Data

(60) Provisional application No. 60/411,701, filed on Sep. 17, 2002.

(51) Int. Cl.
*B63H 20/14* (2006.01)

(52) U.S. Cl. ..... 440/75

(58) Field of Classification Search ..... None
See application file for complete search history.

(56) References Cited

U.S. PATENT DOCUMENTS

| | | | |
|---|---|---|---|
| 965,870 | A | 8/1910 | Cassady |
| 1,252,360 | A | 1/1918 | Moore |
| 2,521,368 | A | 9/1950 | Hingerty, Jr. |
| 2,722,193 | A | 11/1955 | Brindley |
| 3,933,116 | A | 1/1976 | Adams et al. |
| 3,943,790 | A | 3/1976 | Meyer |
| 3,951,096 | A | 4/1976 | Dunlap |
| 3,989,000 | A | 11/1976 | Foley, Jr. |
| 4,676,756 | A | 6/1987 | Rodrigue et al. |
| 4,728,308 | A | 3/1988 | Weismann |
| 4,765,075 | A | 8/1988 | Nakase et al. |
| 4,813,898 | A | 3/1989 | Nakase et al. |
| 4,826,459 | A | 5/1989 | Slattery |
| 4,832,638 | A | 5/1989 | Sirois |
| 4,854,903 | A | 8/1989 | Sirois |
| 4,869,692 | A | 9/1989 | Newman |
| 4,946,410 | A | 8/1990 | Haman |
| 4,981,452 | A | 1/1991 | Grinde |
| 4,992,066 | A | 2/1991 | Watson |
| 5,017,090 | A | 5/1991 | Morrison |
| 5,102,358 | A | 4/1992 | Binversie et al. |
| 5,188,548 | A | 2/1993 | Ferguson et al. |
| 5,741,165 | A | 4/1998 | Saito et al. |
| 5,911,607 | A | 6/1999 | Lacko et al. |
| 5,931,710 | A | 8/1999 | Johnson, Sr. |
| 6,139,380 | A | 10/2000 | Uematsu |
| 6,213,822 | B1 | 4/2001 | Saito et al. |
| 6,234,854 | B1 | 5/2001 | Rydzewski |
| 6,309,265 | B1 | 10/2001 | Oguma |
| 6,361,388 | B2 | 3/2002 | Foreman |
| 6,921,305 | B2 | 7/2005 | Provost |
| 7,048,600 | B1 | 5/2006 | Broussard |
| 7,297,035 | B2 | 11/2007 | Broussard |
| 7,662,005 | B2 | 2/2010 | Provost |
| 2009/0191774 | A1 | 7/2009 | Provost |

FOREIGN PATENT DOCUMENTS

| | | |
|---|---|---|
| CA | 1172111 | 8/1984 |
| GB | 843633 | 8/1960 |
| GB | 1032427 | 6/1966 |
| JP | 9202298 A | 8/1997 |

OTHER PUBLICATIONS

Author Unknown, Mariner Outboards Service Manual, Brunswick Corporation; 1995. (3 pages).

*Primary Examiner*—Jeanne M Clark

(57) ABSTRACT

An air cooled, belt drive and engine assembly mountable to the transom of small flat bottom boats in much the same manner as water cooled outboard engines with a lower foot that does not extend below the bottom of the boat but extends a sufficient distance behind the boat to insure the proper angle of attach when the propeller is in contact with mud and vegetation. The engine mount includes tilt-up capability and pivotal horizontal steering. The propeller is capable of cutting through vegetation, provides propulsive thrust in mud and provides relatively fast boat speed in deep water.

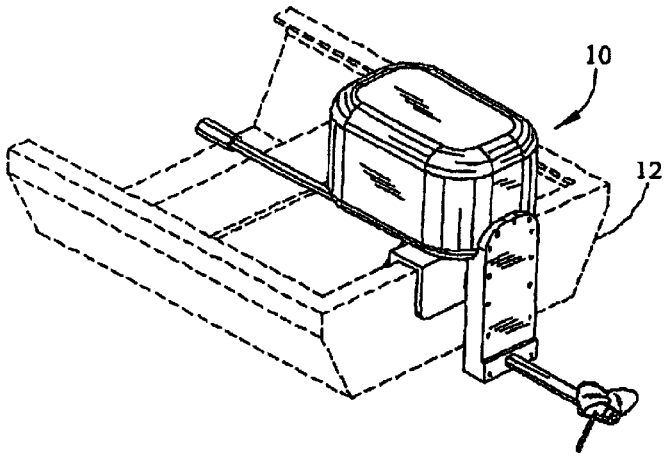

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1-14 is confirmed.

New claims 15-23 are added and determined to be patentable.

*15. A portable drive assembly according to claim 1 wherein the drive housing extends to a position above or approximately flush with the bottom of the watercraft at the transom.*

*16. A portable drive assembly acording to claim 1 said wherein the propeller shaft and its housing extend a distance in excess of 18 inches beyond said drive housing.*

*17. A portable drive assembly according to claim 15 said wherein the propeller shaft and its housing extend a distance in excess of 18 inches beyond said drive housing.*

*18. A portable drive assembly according to claim 6 wherein the drive housing extends to a position above or approximately flush with the bottom of the watercraft at the transom.*

*19. A portable drive assembly according to claim 6 said wherein the propeller shaft and its housing extend a distance in excess of 18 inches beyond said drive housing.*

*20. A portable drive assembly according to claim 18 said wherein the propeller shaft and its housing extend a distance in excess of 18 inches beyond said drive housing.*

*21. A portable drive assembly according to claim 8 wherein the sealed housing extends to a position above or approximately flush with the bottom of the watercraft at the transom.*

*22. A portable drive assembly according to claim 8 wherein said propeller shaft and its housing extend a distance in excess of 18 inches beyond said sealed housing.*

*23. A portable drive assemlby according to claim 21 wherein said propeller shaft and its housing extend a distance in excess of 18 inches beyond said sealed housing.*

* * * * *